US007219885B2

(12) United States Patent
Nardozza

(10) Patent No.: US 7,219,885 B2
(45) Date of Patent: May 22, 2007

(54) SLIDING RACK L-CLAMP HAVING A NON-ROTATING SHAFT

(76) Inventor: John Nardozza, 61 Town Farm Rd., Chester, NH (US) 03036

( * ) Notice: Subject to any disclaimer, the term of this patent is extended or adjusted under 35 U.S.C. 154(b) by 0 days.

(21) Appl. No.: 11/162,213

(22) Filed: Sep. 1, 2005

(65) Prior Publication Data

US 2006/0043661 A1 Mar. 2, 2006

Related U.S. Application Data

(60) Provisional application No. 60/606,758, filed on Sep. 2, 2004.

(51) Int. Cl.
*B25B 1/00* (2006.01)

(52) U.S. Cl. ..... 269/166; 269/249

(58) Field of Classification Search ..... 269/249, 269/228, 166–171.5, 244, 247, 91; 254/420
See application file for complete search history.

(56) References Cited

U.S. PATENT DOCUMENTS 2,159,395 A * 5/1939 Mersereau ..... 254/420
5,174,550 A * 12/1992 Pittman ..... 254/420
5,405,124 A 4/1995 Mayer et al.
5,427,364 A * 6/1995 Zborschil ..... 269/166
5,893,553 A 4/1999 Pinkous
D450,991 S * 11/2001 Nardozza et al. ..... D8/73
6,367,790 B2 4/2002 Ocklenburg et al.

* cited by examiner

*Primary Examiner*—Robert C. Watson
(74) *Attorney, Agent, or Firm*—Robert R Deleault, Esq.; Mesmer & Deleault, PLLC

(57) ABSTRACT

A sliding arm L-clamp includes an L-shaped bar having an arm with a flat arm end and a rail integrally connected to the arm and an adjustable sliding rack assembly. The adjustable sliding rack assembly includes a rack with an opening on a first rack end, a perpendicular tube at a second rack end, an extendable nonrotatable inner tube having a pad on a first extendable inner tube end, and a linear actuating mechanism operably connected to the extendable nonrotatable inner tube for movement of the extendable nonrotatable inner tube between a proximal position adjacent a first perpendicular tube end and a distal position adjacent the flat arm end. The opening is configured for receiving the rail and the extendable nonrotatable inner tube is slidably engaged within the perpendicular tube.

14 Claims, 5 Drawing Sheets

SLIDING RACK L-CLAMP HAVING A NON-ROTATING SHAFT

This application claims the benefit of U.S. Provisional Patent Application No. 60/606,758, filed Sep. 2, 2004.

BACKGROUND OF THE INVENTION

1. Field of the Invention

The present invention generally relates to L-clamps. Particularly, the present invention relates to a sliding rack L-clamp.

2. Description of the Prior Art

A standard L-clamp or bar clamp has a straight bar attached to a fixed arm. A sliding arm slides along the straight bar and the outer end of the sliding arm comprises a threaded screw which comprises a handle on one end and a pad on the other end. When the handle is turned, the pad engages an object being clamped between the pad on the end of the threaded screw and the pad on the end of the fixed arm. However, as the screw is turned the pad at the end of the screw rotates generally causing marring of the object or walking movement or deflection of the screw on the object being clamped.

The related prior art includes U.S. Pat. No. 6,367,790 (2002, Ocklenburg et al.) which discloses a sliding arm L-clamp comprising a bar, an elbow, and an arm. The movable arm extends from the bar, slides along the bar, and has an outer end which is threaded to a spindle carrying a handle or crank at one end and a first abutment pad at the opposite end. The fixed arm carries at its outer end a second abutment pad parallel with the first abutment pad. However, as the spindle turns, the abutment pad turns creating the possibility of marring a workpiece being held in the L-clamp.

U.S. Pat. No. 5,893,553 (1999, Pinkous) discloses a C-shaped clamp having a pad that does not rotate when an elongated threaded rod with an extendible thread surface is screwed toward a ball jointed pad on the opposite end of the C-clamp device. The elongated threaded rod is attached to the top of a pad bracket and a bar means attaches to an end of the pad bracket perpendicular to the rod. The blocking rod prevents the pad bracket from rotating. However, this design does not support the exterior spindle and still allows for pad and spindle rotation, albeit limited.

U.S. Pat. No. 5,405,124 (1995, Mayer) discloses a sliding arm C-shaped clamp bow with a nonrotating pad or clamping body. A clamping spindle is threaded through a spindle nut at one end of the bow. The contact surface of the end of the spindle is secured within the clamping body so that as the contact surface of the spindle rotates within the clamping body, the surface clamping element remains stationary. The clamping body extends from the guide section along the clamp bow. However, this is a C-shaped clamp with a spindle and not an L-clamp and the exposed spindle is unsupported by an exterior housing.

Therefore, what is needed is a sliding arm L-clamp that does not rotate when being tightened. What is further needed is an L-clamp that prevents marring of a workpiece, walking movement, or deflection of a screw on a workpiece when tightening the L-clamp on a workpiece. What is still further needed is an L-clamp that provides fast clamping of a workpiece.

SUMMARY OF THE INVENTION

It is an object of the present invention to provide a sliding arm L-clamp having a pad on the end of a cylindrical tube of the sliding rack that does not rotate when being tightened for holding a workpiece. It is another object of the present invention to provide a sliding arm L-clamp having a non-rotating shaft or inner tube to prevent marring of a workpiece, walking movement, or deflection of a screw on a workpiece when tightening the L-clamp on a workpiece. It is a further object of the present invention to provide fast clamping of a workpiece by sliding a rack along an L-clamp and turning a hex nut on one end of a cylindrical tube which turns a screw rod inside the tube thereby tightening a pad of the sliding rack quickly on the workpiece.

The present invention achieves these and other objects by providing a sliding rack L-clamp for clamping a workpiece having a first clamp means and a second clamp means. First clamp means has an L-shaped bar, and second clamp means has a rack, a cylinder assembly, a pad, a screw rod, and a linear actuating mechanism. The linear actuating mechanism is operably connected to the cylinder assembly. The L-shaped bar has an arm and a rail. The arm and rail form approximately a ninety degree angle. The arm has a flat portion on one end, i.e. the flat arm end, for contacting the workpiece.

The rack has an opening on a first end for slidably receiving the rail of the L-shaped bar therethrough. The cylinder assembly, which is mounted perpendicular to the rack on a second end of the rack and which is axially aligned with the flat arm end, includes an outer tube and a nonrotatable inner tube. The pad attaches to a first end of the inner tube opposite the flat portion of the arm of the L-shaped bar.

The linear actuating mechanism is operably attached to a second end of the inner tube for moving the pad back and forth when a torque providing means engages the linear actuating mechanism for clamping the workpiece. The linear actuating mechanism includes a screw rod, an end cap, a threaded insert, a hex nut, a spring pin, and an optional handle. The end cap attaches within the outer tube. The threaded insert has a first end attached, preferably by a press-fit, into the second end of the inner tube. The screw rod has a threaded portion and a rod end portion. The screw rod is threaded into the threaded insert with a major portion of the threaded portion of the screw rod extending through the threaded insert and into the inner tube. The end portion extends through the end cap. The hex nut receives the end portion of the screw rod and a spring pin passes through the hex nut and the end portion of the screw rod to secure the screw rod within the cylinder assembly.

The objects are further accomplished by an L-shaped bar having an arm and a rail forming approximately a ninety-degree angle, an adjustable sliding rack assembly having a rack with an opening in a first end for receiving the rail of the L-shaped bar and a cylinder assembly attached to a second end of the sliding rack, the cylinder assembly having a first end for contacting a workpiece as the sliding rack is moved toward the arm of the L-shaped bar, and a linear actuating mechanism attached to the second end of the cylinder assembly for extending and retracting the first end of the cylinder without rotating the first end of the cylinder.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of the present invention. The various objects, advantages, and novel features of the present invention will be more fully apparent from a reading of the following detailed description in conjunction with the accompanying drawings in which like reference numerals refer to like parts.

DETAILED DESCRIPTION OF THE PREFERRED EMBODIMENT

Figure 1:
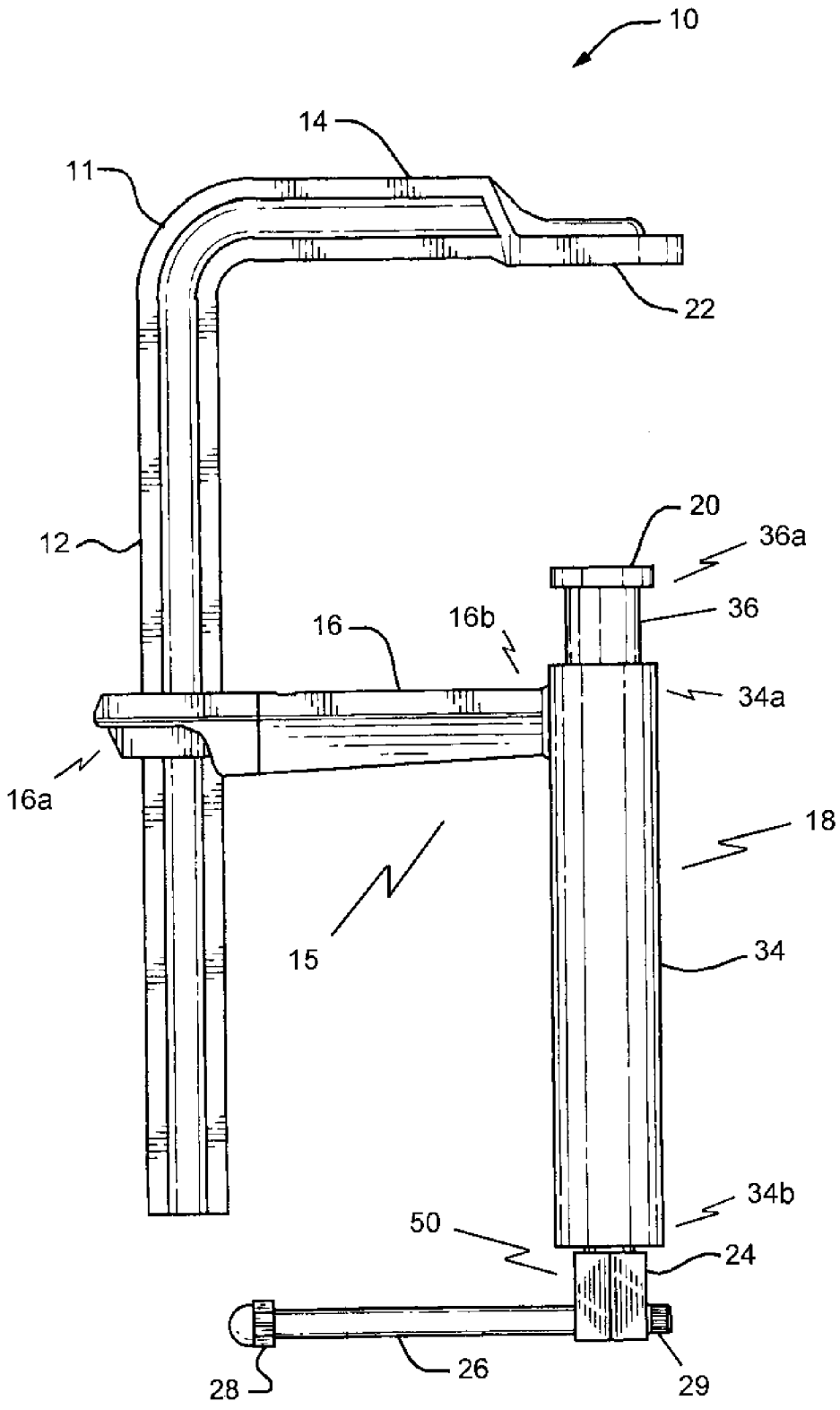
FIG. 1 is a side elevational view of a sliding arm L-clamp having a non-rotating abutment pad according to the present invention.

The preferred embodiment(s) of the present invention is illustrated in FIGS. 1–10. FIG. 1 illustrates a side elevational view of a sliding rack L-clamp 10 having an L-shaped bar 11 and an adjustable rack assembly 15. Adjustable rack assembly 15 includes a rack 16, a cylinder assembly 18, a non-rotating pad 20, and a linear actuating mechanism 50 of which only a portion is shown as a hex nut 24 with an optional handle 26. L-shaped bar 11 has a rail 12 and an arm 14 forming a right angle or an L-shape. At the end of arm 14 on an inner side is a flat arm end 22. Rack 16 includes an opening 17 (not shown) at a first rack end 16*a* for receiving rail 12 of L-shaped bar 11. On the other end of rack 16, i.e. second rack end 16*b*, is cylinder assembly 18 having a pad 20 at one end. Cylinder assembly 18 includes an outer tube 34 and a nonrotatable inner tube or shaft 36. Pad 20 is attached to a first inner tube end 36*a* of inner tube or shaft 36, which extends from a first outer tube end 34*a* of outer tube 34 when a hex nut 24 located adjacent a second outer tube end 34*b* of outer tube 34 is rotated by a handle 26. Pad 20 preferably has a short cylindrical shaft (not shown) having external threads which screws into inner tube or shaft 36.

Optional handle 26 is slidably received through an opening in hex nut 24, and a cap 28 screws onto one end of handle 26 to retain the handle 26. The other end 29 of handle 26 is knurled so that it does not enter hex nut 24. Pad 20 does not rotate as it extends from cylinder assembly 18 from a proximal position adjacent outer tube end 34*a* to a distal position adjacent flat arm end 22 thereby avoiding marring the workpiece 30, walking on the workpiece 30, or causing any deflection of cylinder assembly 18 on the workpiece 30. When handle 26 is removed from hex nut 24, a power tool or a manual wrench may be used to turn hex nut 24.

Figure 2:
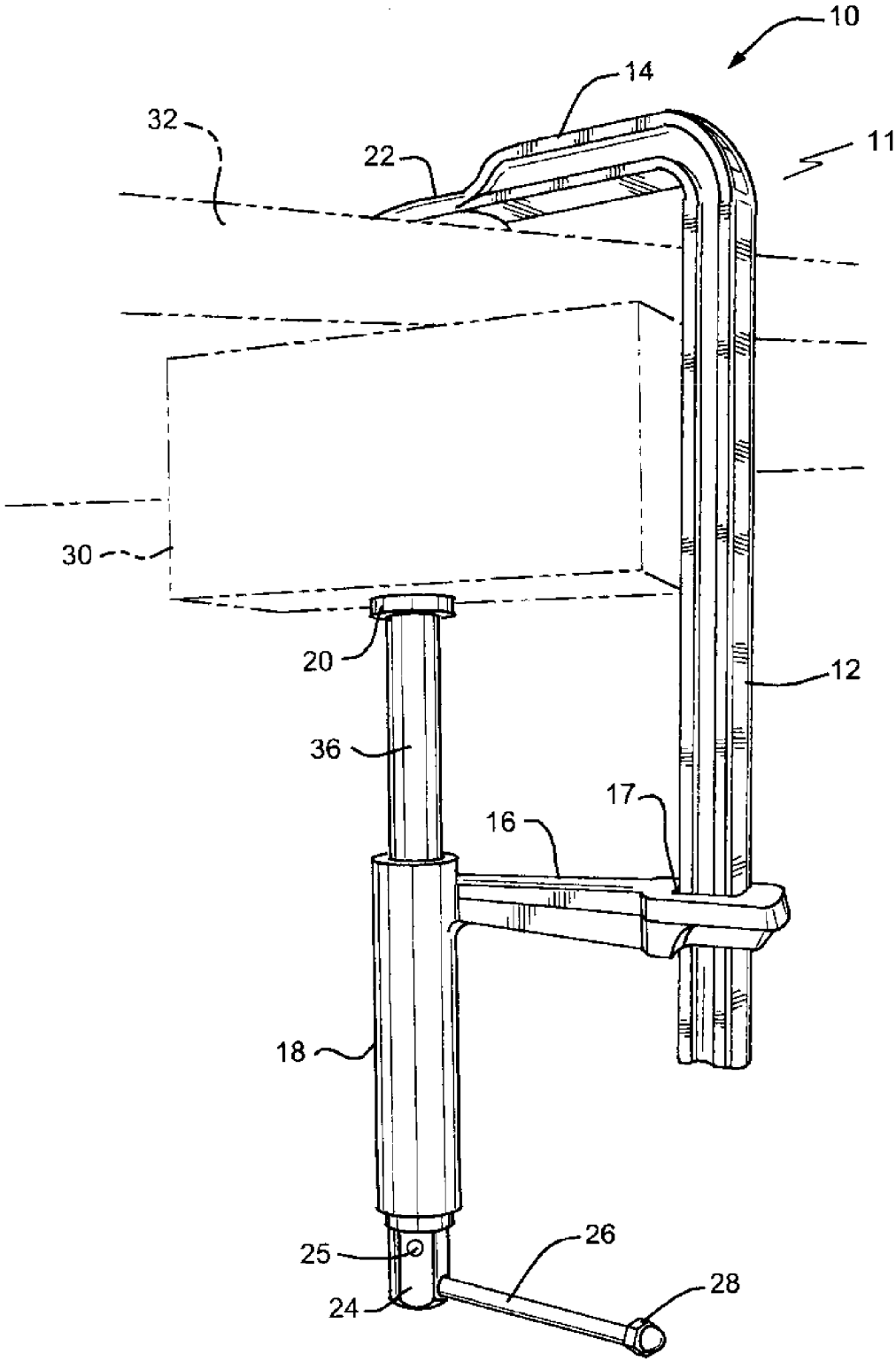
FIG. 2 is a side perspective view of an L-clamp having a non-rotating abutment pad according to the present invention showing workpieces of a block and a board, in phantom, held together by the L-clamp.

Referring to FIG. 2, a perspective view of L-clamp 10 having non-rotating pad 20 is shown clamping a first workpiece 30 to a second workpiece 32. Pad 20 contacts the first workpiece 30 and flat end 22 of arm 14 of L-shaped bar 11 contacts the second workpiece 32. Rail 12 is inserted in opening 17 of rack 16 and pad 20 on the end of shaft 36 has been extended by turning handle 26 to hold the first workpiece 30 in contact with the second workpiece 32.

Figure 3:
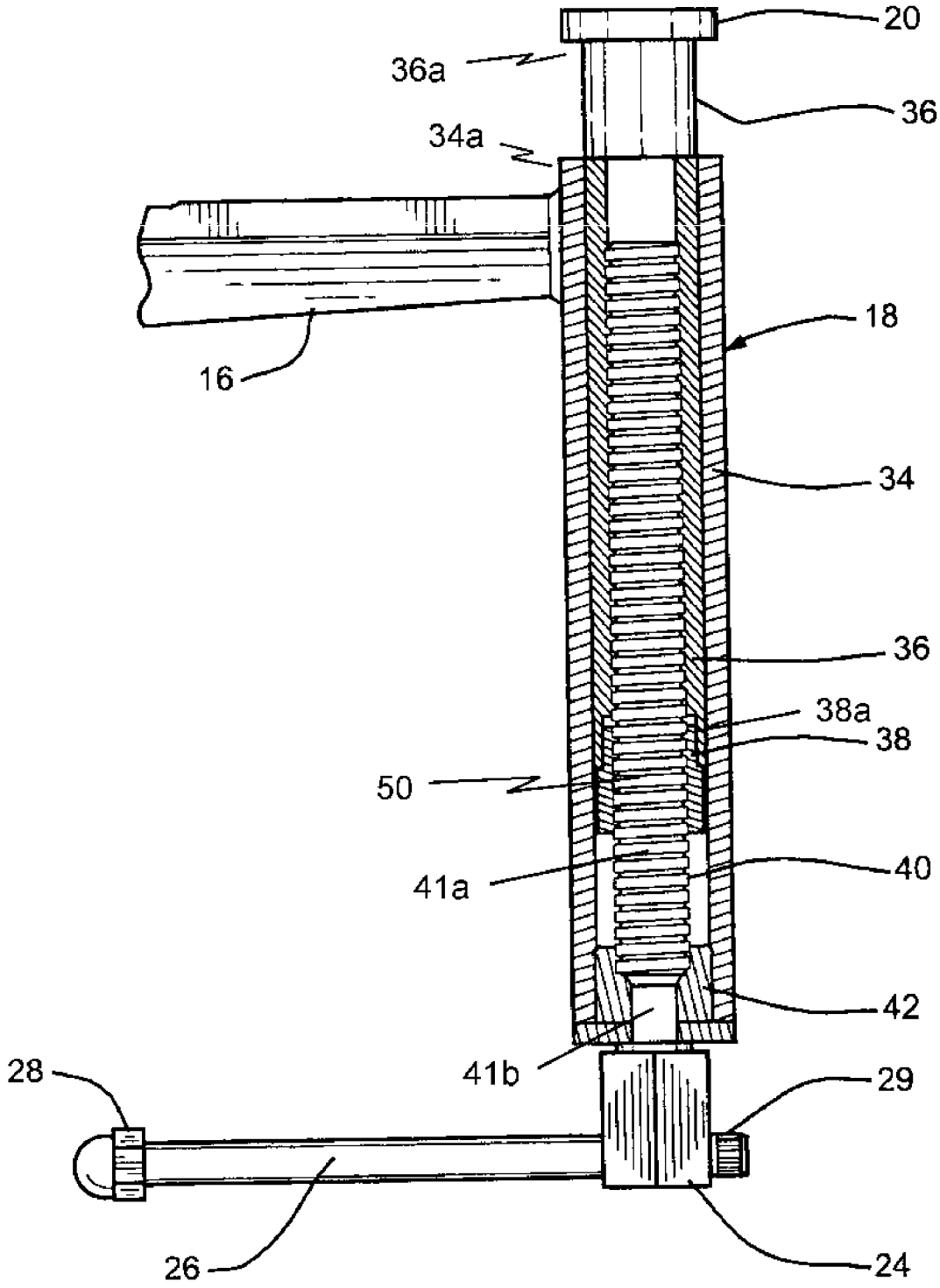
FIG. 3 is a cross-sectional view of a cylinder of the L-clamp of FIG. 1.

Referring to FIG. 3, a cross-sectional view of the cylinder assembly 18 is shown. Cylinder assembly 18 includes an outer tube 34, shaft or inner tube 36, having pad 20 attached at first inner tube end 36*a*, and linear actuating mechanism 50 operably connected to outer tube 34 and inner tube 36. Linear actuating mechanism includes a threaded insert 38, preferably an Acme nut, a screw rod 40, hex nut 24, a spring pin 25*a*, an end cap 42, and optional handle 26. Screw rod 40 is rotated by hex nut 24 or by handle 26 passing through hex nut 24. Rack 16 is welded to the outer wall of outer tube 34 near first outer tube end 34*a* where pad 20 is located.

End cap 42 attaches within second outer tube end 34*b* of outer tube 34 by threading or press fitting. Threaded insert 38 has a first end 38*a* attached, preferably by a press-fit, into the second inner tube end 36*a* of inner tube 36. Screw rod 40 has a threaded portion 41*a* and an end portion 41*b*. Screw rod 40 is threaded into threaded insert 38 with a major portion of threaded portion 41*a* of screw rod 40 extending through threaded insert 38 and into inner tube 36. End portion 41*b* extends through end cap 42. Hex nut 24 receives end portion 41*b* of screw rod 40 and spring pin 25 passes through hex nut 24 and end portion 41*b* of screw rod 40 to secure screw rod 40 within cylinder 38.

Figure 4:
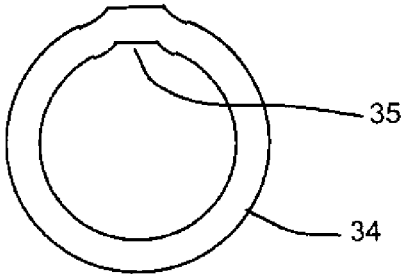
FIG. 4 is an end view of the outer tube of the cylinder of FIG. 3.
Figure 5:
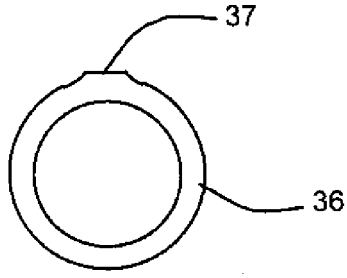
FIG. 5 is an end view of an inner tube of the cylinder of FIG. 3.

Referring to FIG. 4 and FIG. 5, FIG. 4 is an end view of outer tube 34 and FIG. 5 is an end view of inner tube 36 that is slidably received within outer tube 34. Outer tube 34 includes a notch or groove 35 along its entire length. Inner tube 36 includes a ridge or protrusion 37 on the outside of inner tube 36 along its entire length. Ridge 37 is configured to be slidably received within groove 35 of outer tube 34.

Figure 6:
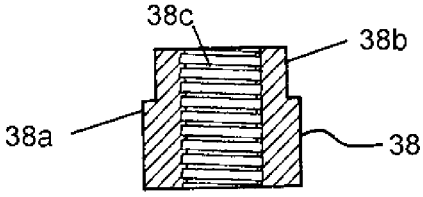
FIG. 6 is a cross-sectional view of an Acme nut of the cylinder of FIG. 3.

Referring now to FIG. 6, there is illustrated a cross-sectional view of threaded insert 38 shown in FIG. 3. Threaded insert 38 has a shoulder portion end 38*a*, a smaller diameter shaft portion 38*b*, and internal threads 38*c*. Internal threads 38*c* are preferably left hand threads. As previously disclosed, threaded insert 38 is preferably an Acme nut. Shaft portion 38*b* is preferably press-fitted into the second inner tube end 36*b* of inner tube or shaft 36, but may also be threaded, welded, pinned, and the like, to secure threaded insert 38 into shaft 36. Screw rod 40 is screwed into threaded insert 38. When screw rod 40 is rotated, threaded insert 38 rides along the threads of screw rod 40 causing inner tube or shaft 36, which is attached to threaded insert 38, to move in and out of outer tube 34 of cylinder assembly 18 by way of first outer tube end 34*a*. Inner tube 36 cannot rotate due to its outer ridge 37 lying within groove 35 of outer tube 34.

Figure 7:
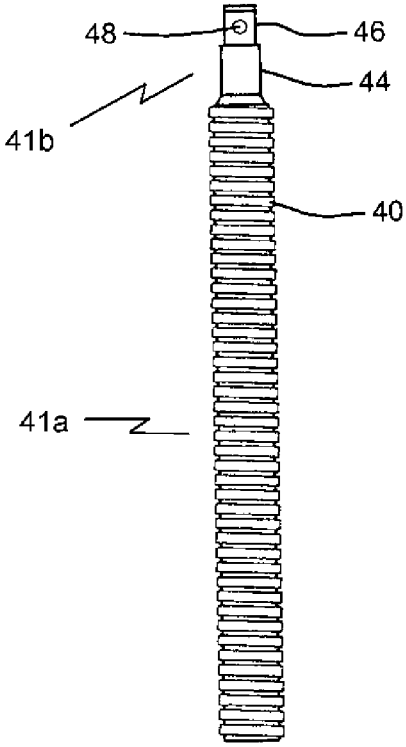
FIG. 7 is a side elevational view of a screw rod of the cylinder of FIG. 3.

FIG. 7 is a side elevational view of screw rod 40. Screw rod 40 includes threaded portion 41*a* and end portion 41*b*. As noted, threaded portion 41*a* extends over a major portion of screw rod 40. End portion 41*b* is shown having two levels of reduced diameters, a first reduced diameter 44 and a second reduced diameter 46. Second reduced diameter includes a through opening 48. First reduced diameter 44 extends through end cap 42 of cylinder 18. As previously disclosed, end cap 42 preferably screws into threads on the inside diameter of outer tube 34. Second reduced diameter 46 extends through end cap 42 and into the middle of hex nut 24. Hex nut 24 also includes a small cylindrical opening 25 that is aligned with a through opening 48 in second reduced diameter 44 of screw rod 40. A spring pin 25*a* is inserted into through opening 48 for retaining the hex nut 24 on end portion 41*b* of screw rod 40.

Figure 8:
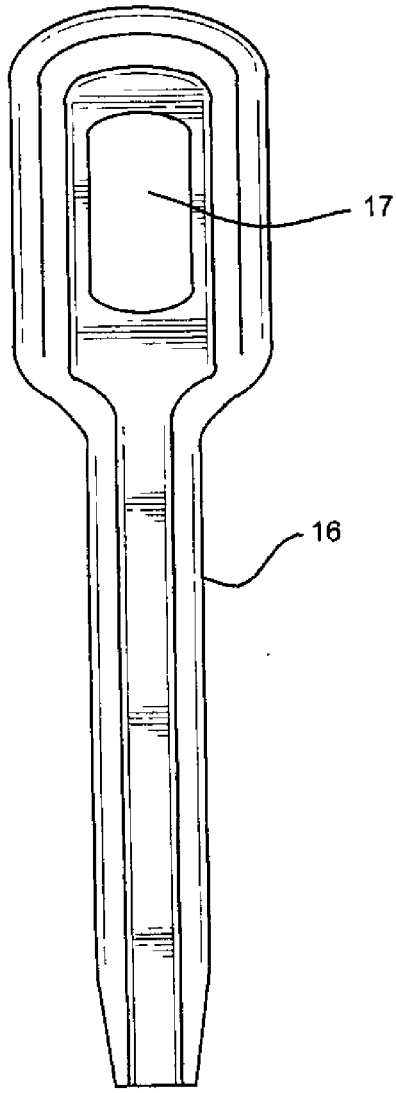
FIG. 8 is a top view of a rack of the L-clamp of FIG. 1.

Referring to FIG. 8, a top view of rack 16 of L-clamp 10 is shown comprising opening 17 for receiving rail 12 of L-shaped bar 11 to pass through in order to facilitate quickly securing workpieces such as workpieces 30, 32 in FIG. 2. Rack 16 slides along rail 12 freely until clamping pressure is applied, at which time a binding of rack 16 and rail 12 prevents movement. The opposite end of rack 16 is attached to cylinder assembly 18 which houses inner tube or shaft 36 with pad 20 on first inner tube end 36*a* of shaft 36 for contacting workpiece 32.

Figure 9:
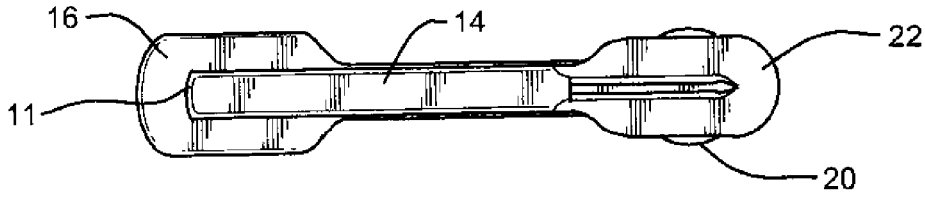
FIG. 9 is a top plan view of the L-clamp of the present invention.
Figure 10:
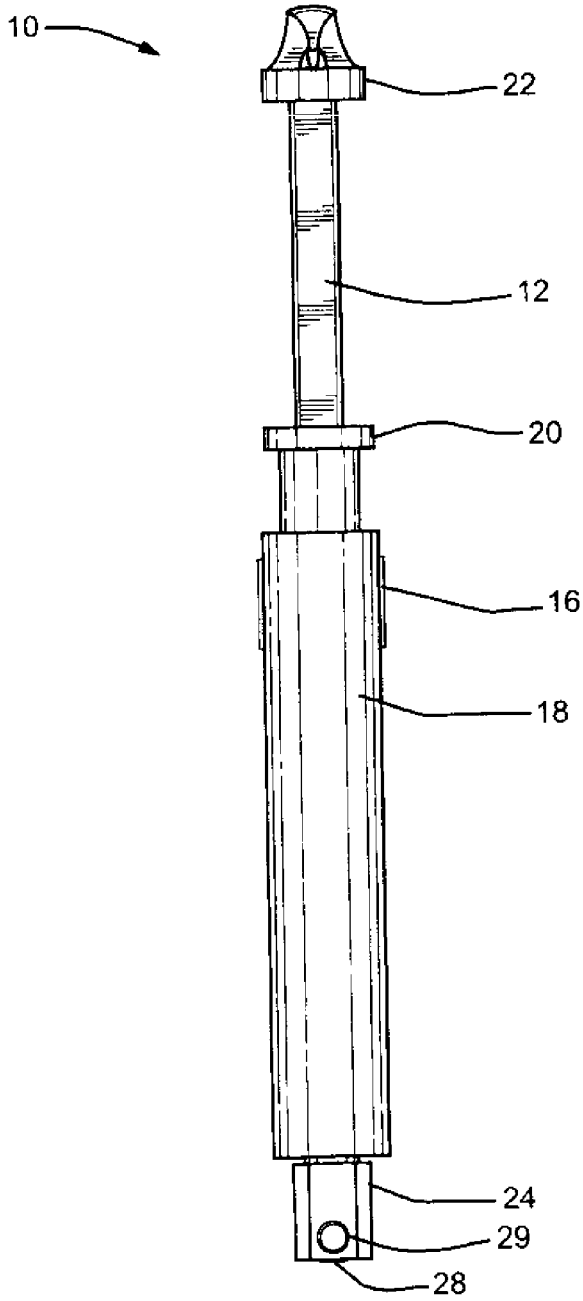
FIG. 10 is a front elevational view of the L-clamp of the present invention.

Referring to FIG. 9 and FIG. 10, FIG. 9 is a top plan view of L-clamp 10 showing arm 14 of L-shaped bar 11. FIG. 10 is a front elevational view of L-clamp 10 showing the end of arm 14 having flat end 22 for contacting workpiece 32 and pad 20 for contacting workpiece 30 as shown in FIG. 2. A front portion of rail 12 of L-shaped bar 11 is shown between flat portion 22 of arm 14 and pad 20.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A sliding arm L-clamp comprising:

an L-shaped bar having an arm and a rail, said arm having a flat arm end;

a rack having a first rack end and a second rack end, said first rack end having an opening for receiving said rail therethrough;

a cylinder assembly mounted perpendicular to said rack on said second rack end, said cylinder assembly having an outer tube with a first outer tube end and a second outer tube end, and an inner tube with a first inner tube end and a second inner tube end wherein said inner tube is slidably engaged within said outer tube;

a pad attached to a first inner tube end opposite said flat arm end wherein said pad has a cylindrical shaft with external threads which screw into said first inner tube end; and a linear actuating mechanism operably connected to said cylinder assembly, said linear actuating mechanism comprising:

a threaded insert mounted to said second inner tube end;

a screw rod having a threaded portion and a rod end portion, said screw rod threadably connected to said threaded insert, said rod end portion rotatably mounted through said second outer tube end; and a hex nut connected to said rod end portion.

2. The sliding arm L-clamp of claim 1 wherein said threaded insert is an Acme nut.

3. The sliding arm L-clamp of claim 1 wherein said inner tube has a ridge along its length sized for slidable engagement with a groove formed on the inside of said outer tube along its length.

4. The sliding arm L-clamp of claim 1 wherein said linear actuating mechanism further includes an end cap connected to said second outer tube end and configured for rotatable engagement with said rod end portion.

5. A sliding arm L-clamp comprising:

an L-shaped bar having an arm and a rail integrally connected to said arm, said arm having a flat arm end; and an adjustable sliding rack assembly comprising:

a rack with an opening on a first rack end and a perpendicular tube axially aligned with said flat arm end at a second rack end, said opening configured for receiving said rail;

an extendable, nonrotatable inner tube having a pad on a first extendable inner tube end wherein said pad is removably connected to said extendable inner tube, said extendable, nonrotatable inner tube slidably engaged within said perpendicular tube; and a linear actuating mechanism operably connected to said extendable nonrotatable inner tube for movement of said extendable nonrotatable inner tube between a proximal position adjacent a first perpendicular tube end and a distal position adjacent said flat arm end.

6. The sliding arm L-clamp of claim 5 wherein said linear actuating mechanism comprising:

a threaded insert attached to a second extendable tube end;

a screw rod having a threaded portion and an unthreaded portion, said threaded portion threadably engaged with said threaded insert and said unthreaded portion rotatably engaged through a second tube end of said perpendicular tube; and a hex nut attached to said unthreaded portion.

7. The sliding arm L-clamp of claim 5 wherein said extendable tube has a ridge along its length sized for slidable engagement with a groove formed on the inside of said perpendicular tube along its length.

8. The sliding arm L-clamp of claim 6 wherein said threaded insert is an Acme nut.

9. A sliding arm L-clamp comprising:

first clamp means having a rail and an arm; and second clamp means having a first end with an opening for receiving said rail and a second end with a cylinder assembly having a pad attached to an extendable non-rotating tube and opposed to said arm wherein said pad is removably connected to said extendable non-rotating tube; and linear actuating means operably engaged with said cylinder assembly wherein said linear actuating means moves said pad and said extendable non-rotating tube between a proximal position adjacent a first end of said cylinder assembly to a distal position adjacent said arm.

10. The sliding arm L-clamp of claim 9 wherein said linear actuating means further includes a threaded insert connected to said extendable non-rotating tube and a screw rod having a threaded portion threadably engaged with said threaded insert and a rod end portion rotatably engaged through a second end of said cylinder assembly wherein said rod end portion is configured for engagement with a torque providing means.

11. The sliding arm L-clamp of claim 10 wherein said cylinder assembly includes an end cap for rotatably engaging said rod end portion.

12. The sliding arm L-clamp of claim 9 wherein said extendable nonrotating tube has a ridge extending along the length of said extendable nonrotating tube.

13. The sliding arm L-clamp of claim 9 wherein said cylinder assembly has an inner surface with a groove extending along the length of said inner surface.

14. The sliding arm L-clamp of claim 10 wherein said torque providing means is a handle, a hand tool or a power tool.

* * * * *